US006028277A

United States Patent [19]

Bachschmid

[11] Patent Number: 6,028,277

[45] **Date of Patent: *Feb. 22, 2000**

[54] DUAL-GANG SWITCH PLATE WITH VOICE RECORDER

[75] Inventor: David E. Bachschmid, Leesburg, Va.

[73] Assignee: BP Holdings, LLC, Middleburg, Va.

[ * ] Notice: This patent is subject to a terminal disclaimer.

[21] Appl. No.: 09/134,733

[22] Filed: Aug. 14, 1998

[51] Int. Cl.[7] ..... H01H 1/26

[52] U.S. Cl. ..... 200/508

[58] Field of Search ..... 200/508, 518

[56] References Cited

U.S. PATENT DOCUMENTS

| | | | |
|---|---|---|---|
| 1,575,469 | 3/1926 | Waterbury . | |
| 1,911,444 | 5/1933 | Fator | 200/508 X |
| 2,015,698 | 10/1935 | Tiffany | 174/66 X |
| 2,802,074 | 8/1957 | Pass . | |
| 2,811,700 | 10/1957 | Kuch . | |
| 3,171,920 | 3/1965 | Klein et al. . | |
| 3,217,112 | 11/1965 | Campbell et al. . | |
| 3,470,339 | 9/1969 | Roman . | |
| 3,522,595 | 8/1970 | White | 174/66 X |
| 3,739,126 | 6/1973 | Sahrbacker et al. . | |
| 3,757,062 | 9/1973 | Lipschutz . | |
| 3,787,653 | 1/1974 | Maher . | |
| 3,839,615 | 10/1974 | Bradford . | |
| 3,892,935 | 7/1975 | Patterson | 200/331 |
| 4,017,699 | 4/1977 | Hellman . | |
| 4,180,712 | 12/1979 | Lutzenberger et al. . | |
| 4,181,838 | 1/1980 | Neuser et al. | 200/330 X |
| 4,324,958 | 4/1982 | Valleau . | |
| 4,331,844 | 5/1982 | Saitoh . | |
| 4,429,201 | 1/1984 | Dekkers et al. . | |
| 4,704,503 | 11/1987 | Takasawa . | |
| 4,879,443 | 11/1989 | Carlucci et al. | 200/331 X |
| 5,164,694 | 11/1992 | DeVault et al. . | |

*Primary Examiner*—Renee S. Luebke
*Attorney, Agent, or Firm*—Whitham, Curtis & Whitham

[57] ABSTRACT

A pair of sliding plates engage respective moveable structures such as the actuating lever of an existing wall switch and are housed in a dual-gang or larger cover plate body. A cam, preferably formed on an edge of each sliding plate, engages a cam follower on respective resilient conductive contact blades; a pair of contact blades being preferably positioned between edges of the sliding plates. Movement of either electrical switch operating levers through an intermediate position causes a respective contact blade to engage and form a momentary electrical contact with the other contact blade with a bi-directional wiping motion. Both contact blades may be simultaneously urged toward the other by respective cams.

7 Claims, 4 Drawing Sheets

DUAL-GANG SWITCH PLATE WITH VOICE RECORDER

CROSS-REFERENCE TO RELATED APPLICATIONS

This application is related to U.S. Pat. No. 5,871,086, filed Jul. 23, 1997, which is hereby fully incorporated by reference.

BACKGROUND OF THE INVENTION

1. Field of the Invention

The present invention generally relates to miniature switches for electrical and electronic apparatus and, more particularly, to miniature switches suitable for mounting with electronic apparatus in an electrical switch cover plate to monitor actuation of electrical switches.

2. Description of the Prior Art

It has recently been proposed to provide a voice recording device in an electrical wall switch plate, such as is disclosed and claimed in U.S. patent application Ser. No. 08/685,609, filed Jul. 24, 1996, of which the present inventor is a joint inventor and which application is hereby fully incorporated by reference as if the text thereof were fully set forth herein. In this combination, it is contemplated that the actuation of the wall switch should cause the playback of an audio message of one or more messages (possibly of a sequence of messages) that may be recorded at will, preferably by recording samples of the message in random access memory or other solid state memories.

Such recordation has been facilitated by recent reductions in cost of relatively large capacity semiconductor memories and integrated circuits capable of conversion of analog signals to digital signals and vice-versa. Thus, it is possible to provide the necessary electronics, including a speaker, microphone and battery power supply within a wall switch plate cover with only a relatively modest increase in the thickness thereof (e.g. about a 7/16 inch overall thickness, increasing thickness over a conventional switch plate generally by less than ¼ inch).

However, providing sensing of operation of a wall switch as desired for this application within a switch plate cover is not trivial. The existing wall switch provides the mounting arrangement for the switch plate and conventional switch plates are designed to be drawn tightly against the body of the wall switch with virtually the entirety of the actuating lever of the wall switch protruding therethrough. Of course, external mechanisms would be unsightly and potentially dangerous.

Current sensing in the controlled circuit is less than fully reliable due to possible variation or disconnection of the load controlled by the switch and, in any event, it is desirable for purposes of simplicity and safety of installation of the device to retrofit it to an existing wiring system without disturbance of existing wiring in any way. Prevailing electrical codes may prohibit and restrict any incursion of any portion of the device or its circuitry into an existing electrical wiring box.

Accordingly, the above-incorporated U.S. Pat. No. 5,871,086 is directed to switch structures and actuating linkages therefor which are very thin and provide a momentary contact connection as an electrical switch lever is moved through a position intermediate between extreme positions. However, it is often the case that several electrical switches will be provided together in the electrical system of a building in which such a device will be desired and the device activated upon the actuation of any of two or more electrical switches. In such a case, the linkages and switches can be provided for any or all switches which are ganged together in a single electrical box and the switches connected in parallel so that actuation of any electrical switch for which a linkage and momentary contact switch is provided will actuate the device.

However, such an arrangement is less than optimally efficient for manufacture. Further, while the switch structures disclosed in the above-incorporated U.S. Pat. No. 5,871,086 are highly reliable, difference in frequency of actuation of the electrical switches may cause different levels of wear. Additionally, near simultaneous actuations of two or more switches may result in multiple control signals for the device which may result in malfunction or an undesired restarting of operation. Further, the contacts of such switches may be exposed to ambient gases and/or particulate matter in the atmosphere and within the electrical installation which may cause fouling, oxidation and/or corrosion of the contacts.

SUMMARY OF THE INVENTION

It is therefore an object of the present invention to provide a miniature switch structure which is suitable for inclusion within an electrical switch cover plate that provides a single momentary contact upon the actuation of either or both of two electrical switches.

It is another object of the invention to provide a switch structure with contacts having a bidirectional wiping action which is similar for different modes of actuation in response to respective actuations of electrical switches.

In order to accomplish these and other objects of the invention, a momentary contact switch is provided comprising a support structure, two sliding plates, each having an aperture to engage an actuating lever of an electrical switch, each sliding plate being slidable along a locus relative to the support structure, means moveable with each of the two sliding plates to control movement of a respective electrical contact of a pair of electrical contacts against a another electrical contact of said pair of electrical contacts at a position intermediate between two extreme positions of said sliding plate.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
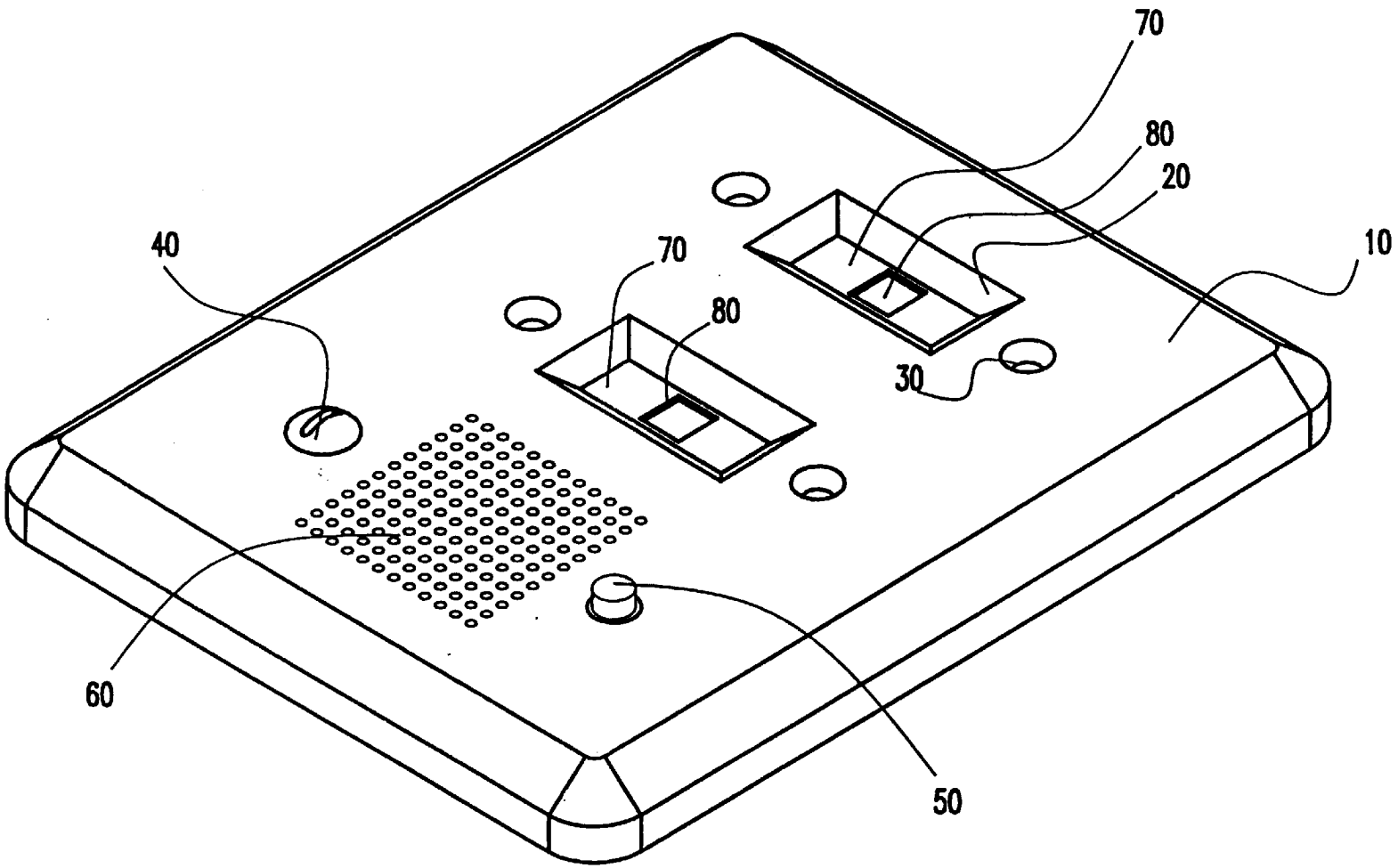
FIG. 1 is an isometric view of a dual-gang switch plate and recording device in accordance with the invention.

Referring now to the drawings, and more particularly to FIG. 1, there is shown, in an isometric view, a dual-gang switch plate and recording device in accordance with the invention. The switch plate cover body 10 includes two apertures 20 corresponding to two ganged electrical switches through which their respective operating levers may protrude. Apertures 30 provide for attachment of the body 10 to the respective bodies of the switches in a conventional manner. In a manner which preferably simulated such attachment screws, a microphone aperture 40 and a record function control button 50 are also provided with a speaker grille therebetween. Apertures 60 are provided as a grille for a miniature speaker which may be placed behind the grille.

Figure 2:
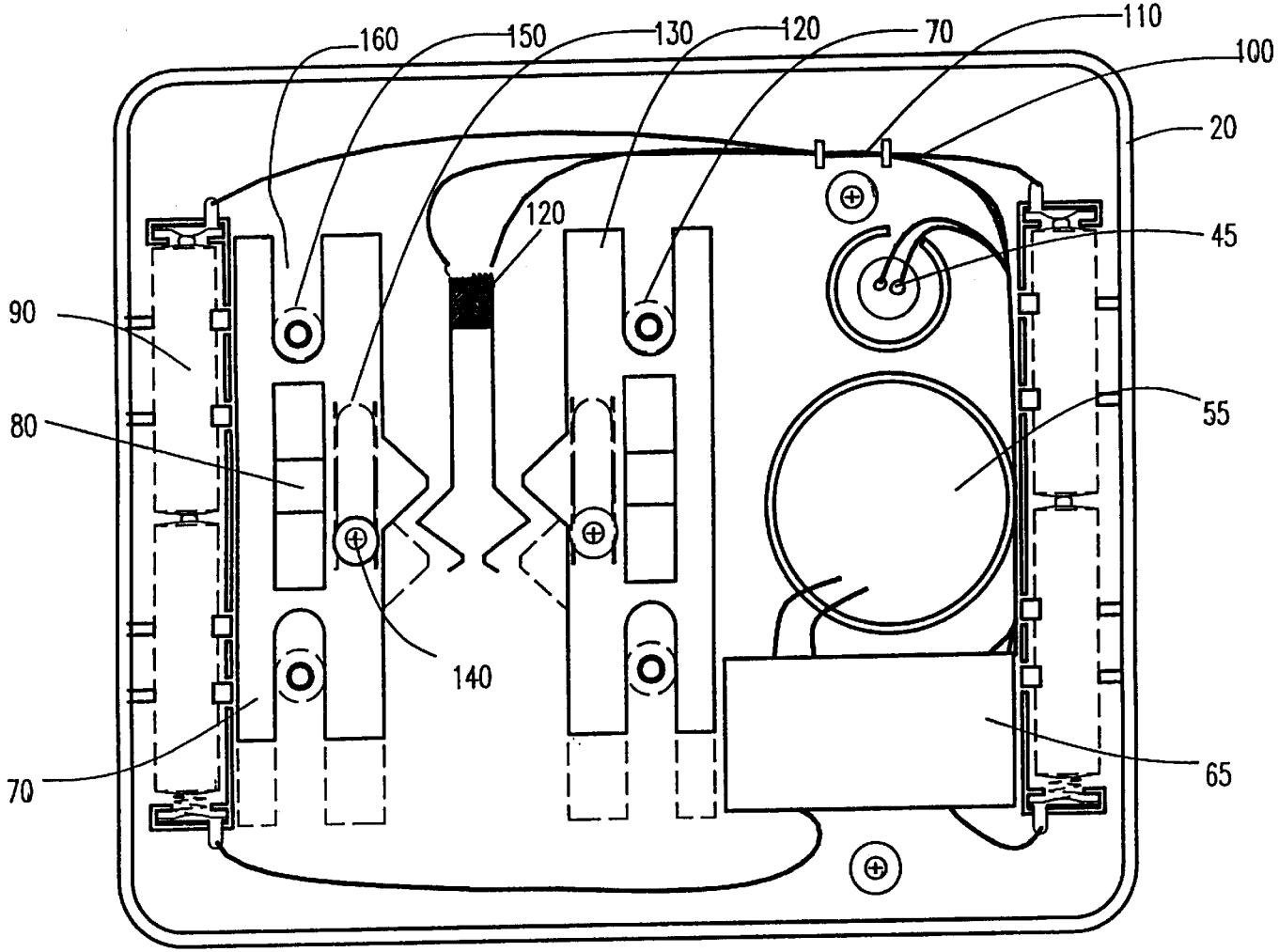
FIG. 2 is a rear plan view of the dual-gang switch plate and recording device of FIG. 1.

Visible through apertures 20 in FIG. 1 is a portion of respective sliding plates 70, each having an aperture 80 therein dimensioned to engage the operating lever of a respective electrical switch. The entirety of the sliding plates is visible in the rear plan view of the device of FIG. 2. Also visible in FIG. 2 are the microphone 45, speaker 55 and recording and playback device 65. Power for the recording and playback device is provided with batteries 90. Wiring 100 may be routed in any convenient manner.

Sliding plates 70 are configured in the basic shape of and "H" with aperture 80 located centrally therein. The sliding plate is preferably retained together with cover plate body 20 by a screw and washer 140 extending through and over slot 130. The sliding plate is further guided by slots 160 which ride against bosses 150 which also provide spacing of the cover plate body 20 from the electrical switches to which the cover plate body 20 is attached. Thus, clearance is provided to prevent binding of the sliding plate 70 between the cover plate body 20 and the electrical switches. Control switch 120 is mounted between the sliding plates 70 in a manner not critical to the practice of the invention and is actuated by cams 200 formed on the sides of the respective sliding plates 70 which will now be discussed in regard to FIGS. 3–6.

Figure 3:
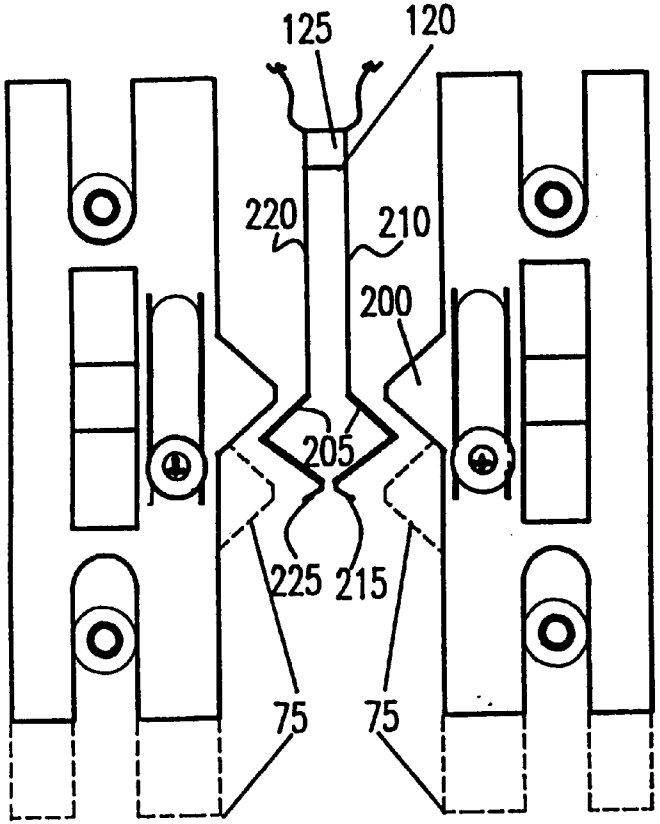
FIG. 3 illustrates a mode of operation of the momentary switch in accordance with the invention.

FIG. 3 shows the sliding plates 70 in an extreme upward position. An extreme downward position of the sliding plate 70 and cam 200 is indicated by dashed lines 75. Switch 120 preferably comprises two flexible conductive blades 210, 220, attached to and separated by an insulator body 125, which may, preferably, be a boss on the interior of cover plate body 20. Blades 210 and 220 also preferably have outwardly projecting cam follower portions 205 which may be formed by curvature or bending of the blades or by a body of insulating or conductive material attached thereto. Respective contact portions 215, 225, are formed at (or by) the ends of blades 210, 220. The shape thereof is not at all critical to the practice of the invention.

Figure 4:
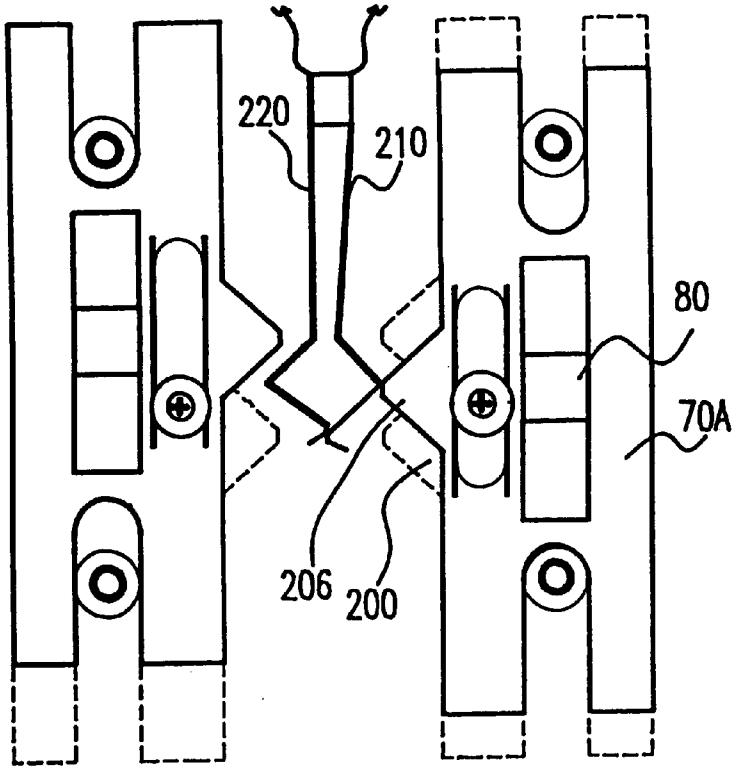
FIG. 4 illustrates a mode of operation of the momentary switch in accordance with the invention.
Figure 5:
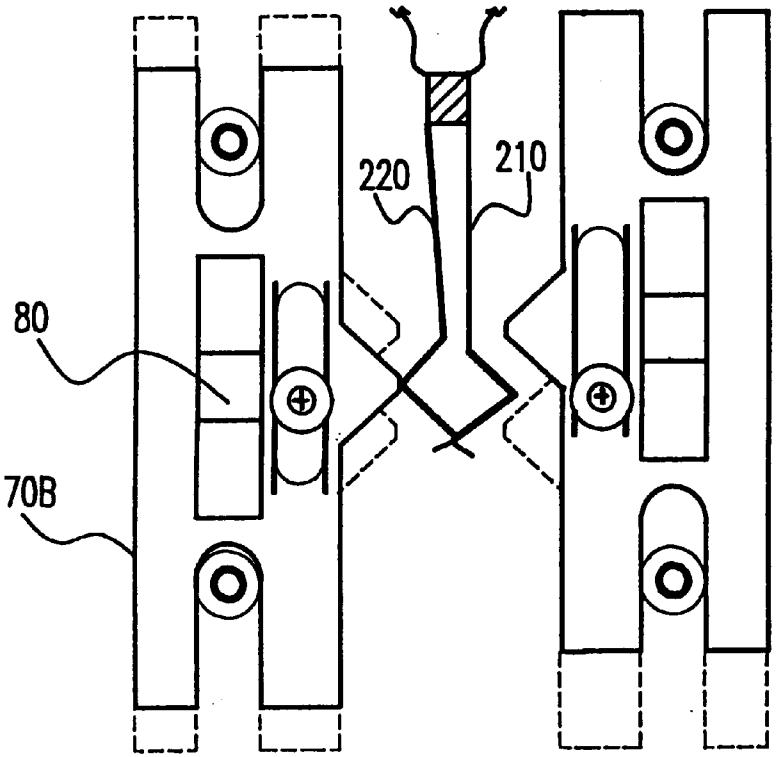
FIG. 5 illustrates a mode of operation of the momentary switch in accordance with the invention.

With the slidable plates 70 at either of the extreme positions of travel, cams 200 do not engage or apply a force to the cam followers 205 and the blades 210, 220 are separated, as shown in FIG. 3. If, however, either slidable plate 70*a*, 70*b* is moved through an intermediate position between extreme positions by actuation of an electrical switch actuating lever extending through aperture 80, as shown in FIGS. 4 and 5, respectively, a respective one of blades 210, 220 will be pressed toward the other causing their contact portions to contact each other and form a momentary connection therebetween. As can be seen, the blade which is pressed by a cam of a corresponding sliding plate 70*a*, 70*b*, is slightly and elastically distorted causing its contact portion to wipe against the contact portion on the other blade. This wiping action is bi-directional making the switch contacts self-cleaning and tending to equalize wear regardless of which sliding plate may be brought through an intermediate position more often to actuate switch 120 and regardless of the direction of motion of the respective sliding plates.

Figure 6:
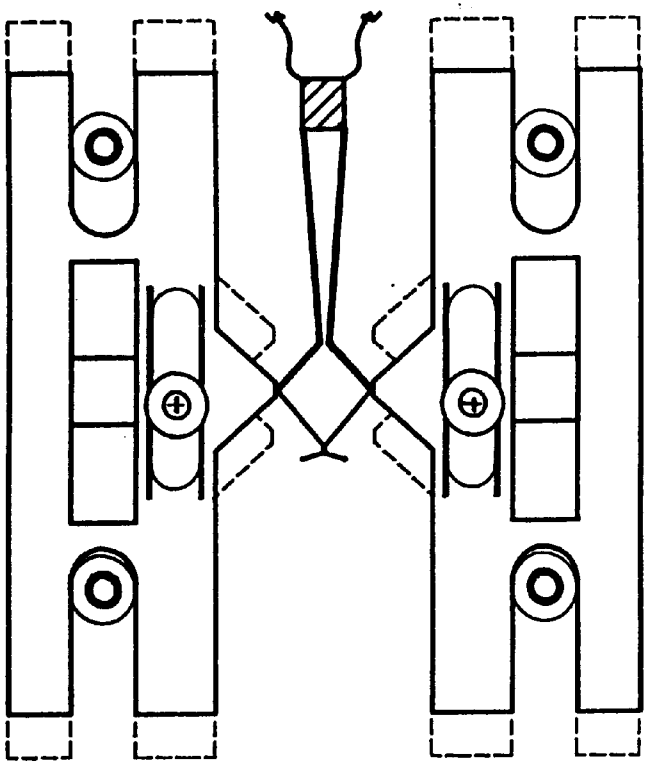
FIG. 6 illustrates a mode of operation of the momentary switch in accordance with the invention.

If, as shown in FIG. 6, both electrical switches and sliding plates 70 are brought to an intermediate position simultaneously, both blades 210, 220, are simultaneously distorted toward each other and, accordingly, greater flexure of the blades will occur in the vicinity of both cam follower portions 205. This action causes a slight rotating and wiping action at contact portions 215, 225 which is also symmetrical and bi-directional tending to make the contacts self-cleaning and tending to equalize wear as in the cases of FIGS. 4 and 5.

Operationally, as the respective sliding plates respectively approach and pass intermediate positions it should be noted that one or more of the states illustrated in FIGS. 4–6 will always occur. For example, if both sliding plates 70*a* and 70*b* are moved between extreme positions but with sliding plate 70*a* slightly in advance of sliding plate 70*b*, the state shown in FIG. 4 will first occur followed by a change of state to that of FIG. 6. As movement continues, the state of FIG. 5 will be assumed followed by the state of FIG. 3 when both sliding plate have passed the intermediate position. It can be appreciated that contact between contact portions 215, 225 of blades 210 and 220 is maintained throughout these changes of state and repeated momentary contacts are avoided while the contact portions 215, 225 are caused to vigorously wipe against each other.

In view of the foregoing, it can be seen that the switch structure in accordance with the invention provides for monitoring of actuation of two electrical switches with a minimum number of extremely simple and inexpensive parts. The control switch thus formed is highly reliable, rugged and self-cleaning and avoids multiple momentary contact signals being generated from concurrent actuation of the two monitored electrical switches.

While the invention has been described in terms of a single preferred embodiment, those skilled in the art will recognize that the invention can be practiced with modification within the spirit and scope of the appended claims. For example, the invention can be applied to more than two electrical switches in pairs or in combination with one or more control switches as described in the above-incorporated applications. The control switch as described above can also be actuated by a single cam on either side thereof.

Having thus described my invention, what I claim as new and desire to secure by Letters Patent is as follows:

1. A momentary contact switch comprising a support structure, two sliding plates, each having an aperture to engage an actuating lever of an electrical switch, each of said two sliding plates being slidable along a locus relative to said support structure, means moveable with each of said two sliding plates to control movement of a respective electrical contact of a pair of electrical contacts against a another electrical contact of said pair of electrical contacts at a position intermediate between two extreme positions of each of said two sliding plates.

2. A momentary contact switch as recited in claim 1, wherein each of said pair of electrical contacts comprises a resilient conductive blade.

3. A momentary contact switch as recited in claim 2, wherein said means moveable with each of said two sliding plates comprises a cam and each said resilient conductive blade includes a cam follower portion.

4. A momentary contact switch as recited in claim 1, wherein said support structure is a switch cover plate body.

5. A momentary contact switch as recited in claim 4 wherein said switch cover plate body includes means for accommodating a recording and playback device.

6. A momentary contact switch as recited in claim 5, wherein each of said pair of electrical contacts comprises a resilient conductive blade.

7. A momentary contact switch as recited in claim 6, wherein said means moveable with each of said two sliding plates comprises a cam and each said resilient conductive blade includes a cam follower portion.

* * * * *